US006613969B1

(12) United States Patent
Petillo et al.

(10) Patent No.: US 6,613,969 B1
(45) Date of Patent: Sep. 2, 2003

(54) FRET FOR STRINGED INSTRUMENTS

(76) Inventors: Phillip J. Petillo, 1206 Herbert Ave., Ocean, NJ (US) 07712; David M. Petillo, 1206 Herbert Ave., Ocean, NJ (US) 07712

( * ) Notice: Subject to any disclaimer, the term of this patent is extended or adjusted under 35 U.S.C. 154(b) by 0 days.

(21) Appl. No.: 10/074,735

(22) Filed: Feb. 13, 2002

(51) Int. Cl.[7] ..... G10D 3/00
(52) U.S. Cl. ..... 84/314
(58) Field of Search ..... 84/314 R, 293, 84/312 R

(56) References Cited

U.S. PATENT DOCUMENTS 4,064,779 A 12/1977 Petillo ..... 84/314
4,723,469 A * 2/1988 Vogt ..... 84/314 R
5,952,593 A * 9/1999 Wilder ..... 84/314 R
6,252,149 B1 * 6/2001 Matsushita ..... 84/314 R
6,369,306 B2 * 4/2002 Chapman ..... 84/314 R

OTHER PUBLICATIONS

"Guitarmaking" by W. R. Cumpiano et al., *Chronicle Books*, 1987, pp. 270–272.
"Electric Guitars" by Tony Bacon, *Thunder Bay Press*, 2000, pp. 246–247.
Stewart–MacDonald Catalog, 2002, pp. 8 and 100.

* cited by examiner

*Primary Examiner*—Shih-Yung Hsieh
(74) *Attorney, Agent, or Firm*—Michael B. Einschlag

(57) ABSTRACT

One embodiment of the present invention is a fret adapted for insertion into a fingerboard of an instrument, the fret comprising: (a) a stem adapted to engage the fingerboard when inserted therein, the stem having one or more studs; and (b) a cap having a base joined to one end of the stem; wherein one or more of the studs comprises a wedge having a sloped side whose area has a quadrilateral shape.

22 Claims, 2 Drawing Sheets

FRET FOR STRINGED INSTRUMENTS

TECHNICAL FIELD OF THE INVENTION

One or more embodiments of the present invention pertain to a fret for stringed instruments.

BACKGROUND OF THE INVENTION

A stringed instrument such as, for example, and without limitation, a guitar, typically includes a fingerboard over which strings extend. Such a stringed instrument often comprises frets that are located in the fingerboard (at predetermined locations beneath the strings). In use, the length of a string is varied by pressing the string into contact with one or more of the frets, and the string is plucked to provide a tone. The tone is changed by varying the string length.

FIG. 1 shows a perspective view of fret 100 that is fabricated in accordance with the prior art. As shown in FIG. 1, when viewed end-on, fret 100 has a somewhat T-shaped configuration comprised of stem 110 (also referred to as "tang 110") and cap 120. As is further shown in FIG. 1, studs $\mathbf{130}_1$ to $\mathbf{130}_4$ protrude from tang 110. To construct a stringed instrument, tang 110 is inserted into the fingerboard of the instrument to secure or anchor fret 100 (U.S. Pat. No. 4,064,779 to Phillip J. Petillo discloses alternative shapes for cap 120).

Studs $\mathbf{130}_1$ to $\mathbf{130}_n$ hold fret 100 in a slot in the neck of the stringed instrument by compression, analogous to the manner in which a nail holds when driven into a piece of wood. Fret 100 is typically fabricated as a cold-rolled wire. As set forth in a book entitled "Guitarmaking" by W. R. Cumpiano and J. D. Natelson, published by *Chronicle Books of San Francisco,* 1993, copyright date 1987 ("Guitarmaking"), at p. 271: "Most modern fret wire is made from what is called eighteen percent nickel/silver. The term denotes a common alloy used in many commercial and industrial applications where high corrosion resistance is required and where excellent cold working properties are necessary for fabrication. Eighteen percent nickel/silver is actually a copper alloy, containing eighteen percent nickel and either fifty-five percent copper and twenty-seven percent zinc, or sixty-five percent copper and seventeen percent zinc. Fret wire is made from the latter variety. . . An alloy harder than eighteen percent nickel/silver would yield longer-lasting frets, but would quickly wear out the high-speed machinery on which it is formed."

The use of frets consisting of a soft material such as eighteen percent nickel/silver is problematic for a number of reasons. For example, the tops of frets consisting of a soft material may become roughened or worn from use (for example, the top of the fret may become flattened or dented by repeated contact with the strings). This, in turn, causes problems such as: (a) producing a rasping noise or a buzz whenever a string is pressed against the roughened or worn fret; (b) wearing out strings; and (c) projecting a poor sound to the instrument. In addition, as is well known, the length between a central axis passing longitudinally through a long axis of cap 120 of fret 100 and a fixed end of a string defines a distance whereby a string of that length will provide a tone of precise frequency when the string is plucked. However, if cap 120 of fret 100 is worn down, proper tonal qualities may not be produced.

In addition, use of the prior art fret shown in FIG. 1 creates problems in reliably seating the fret without it subsequently being loosened through use. Frets become loose for several reasons. First, after replacing frets in an instrument ("refretting"), the slots for the frets may become too wide due to pulling out of the old frets. Second, a fret sometimes pops out of a fingerboard because, when first made, a slot is too wide or a fret tang is too narrow. Third, wood in a wooden fingerboard may become soft and spongy due to too much moisture in the wooden fingerboard or from using oil on the fingerboard.

In light of the above, there is a need in the art for frets that: (a) are long-lasting; and (b) can be reliably seated.

SUMMARY OF THE INVENTION

One or more embodiments of the present invention satisfy one or more of the above-identified needs in the art. In particular, one embodiment of the present invention is a fret adapted for insertion into a fingerboard of an instrument, the fret comprising: (a) a stem adapted to engage the fingerboard when inserted therein, the stem having one or more studs; and (b) a cap having a base joined to one end of the stem; wherein one or more of the studs comprises a wedge having a sloped side whose area has a quadrilateral shape.

DETAILED DESCRIPTION

Figure 2:
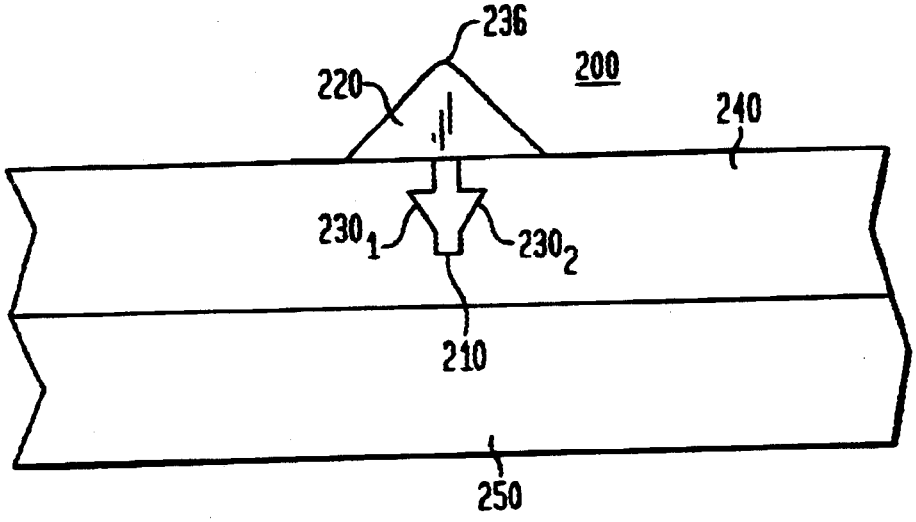
FIG. 2 shows an end view of one embodiment of a fret fabricated in accordance with the present invention.

FIG. 2 shows an end view of one embodiment of a fret fabricated in accordance with the present invention. As shown in FIG. 2, fret 200 comprises stem 210 (also referred to as "tang 210") and cap 220. As further shown in FIG. 2, studs $\mathbf{230}_1$ and $\mathbf{230}_2$ protrude from tang 220. As still further shown in FIG. 2, fret 200 is inserted into fingerboard 240 which is disposed over neck 250 of a stringed instrument. As yet still further shown in FIG. 2, the sides of cap 220 have substantially straight edges (the sides of cap 220, in three dimensions, are substantially planar surfaces), and the top of cap 220 has rounding 236 which has a small radius. For example, in accordance with one embodiment of the present invention, rounding 236 has a small radius of from about 0.008" to about 0.045". It has been discovered that a fret with a rounding having a small radius is useful in producing excellent intonation for the stringed instrument. It has also been discovered that creating a high polish for rounding 236 is useful in that it becomes easier to bend a string to create a tone. Various embodiments of studs $\mathbf{230}_1$ and $\mathbf{230}_2$ will be described below in conjunction with FIGS. 3–5.

In practice, whenever a fret is installed in a fingerboard, a glue or an epoxy is used to glue the fret tang, along with the studs, to the fingerboard. This helps hold the fret securely in the fingerboard. For example, the glue may be a water-based glue, an alcohol-based glue, a polyurethane based glue, or an epoxy. It has been discovered that when a fret is inserted into a wooden fingerboard, and a water-or alcohol-based glue is utilized, the glue appears to harden the wood in the area of the fret. It is believed that in this case, the glue is absorbed into the wood, thereby hardening the wood.

In practice, whenever frets are first installed in a fingerboard, some are a little higher or lower than others. This requires that the tops of the frets be leveled. This may be done, for example, and without limitation, using an 800 grit, 1"×1"×6"stone. After "stoning" or leveling the frets, the tops are rough. Other choices of grit size or leveling applicator for performing this leveling step may be readily determined by those of ordinary skill in the art without undue experimentation. In a next step, the tops may be polished, for example, and without limitation, with a 500 grit abrasive cloth, then with an 800 grit crocus cloth (as is known, crocus cloth is a fine abrasive that is used for polishing metal before buffing), and then with a 1200 grit crocus cloth. Other specific choices of grit size, and sequences of grit size to use for performing this polishing step may be readily determined by those of ordinary skill in the art without undue experimentation. In accordance with one embodiment of the present invention, the last polishing step may utilize a wooden block with a rubber sheet or a cork sheet or a sheet of other material attached to the wooden block. The block may be coated with a film of polishing compound such as, for example, and without limitation, jewelers' rouge, or diamond dust. Further suitable materials may be used, such as, without limitation, an aluminum oxide grease-mix compound available from McMaster-Carr of Dayton, N.J., or luster-lap diamond lapping compounds also available from McMaster-Carr. The polishing steps entail polishing across the frets in a direction along the length of the fingerboard, as well as polishing across the frets in a direction transverse to the length of the fingerboard. Further, a tool having a groove that fits rounding 236 may be used to further polish the top of the frets, and a tool having angled sides may be used to polish the sides of fret 200 that are exposed over the fingerboard. Following the polishing steps, the frets may be buffed by hand, or by use of a buffing wheel. Many suitable buffing wheels may be obtained, for example, from McMaster-Carr (for example, and without limitation, cut-and-color buffs, heavy duty-ventilated cloth buffs, Canton Flannel buffs, mandrel-mounted felt bobs, and shank-mounted cotton buffs).

In order to lengthen the useful life of fret 200, one or more embodiments of the present invention are fabricated from hard materials. For example, such frets may be fabricated using materials having a hardness in a range of from about 2.5 mohs to about 8.7 mohs. Such frets may be fabricated from: (a) stainless steel alloys (many such materials having a hardness in a range of from about 5.0 mohs to about 8.5 mohs are well known to those of ordinary skill in the art); (b) monel alloys (many such materials having a hardness in a range of from about 2.5 mohs to about 8.7 mohs are well known to those of ordinary skill in the art); (c) nickel alloys (many such materials having a hardness in a range of from about 2.5 mohs to about 8.7 mohs are well known to those of ordinary skill in the art); (d) titanium alloys (many such materials having a hardness in a range of from about 2.5 mohs to about 8.7 mohs are well known to those of ordinary skill in the art); (e) molybdenum alloys (many such materials having a hardness in a range of from about 2.5 mohs to about 8.7 mohs are well known to those of ordinary skill in the art); (f) ceramic materials (many such materials having a hardness in a range of from about 4.2 mohs to about 8.2 mohs are well known to those of ordinary skill in the art); (g) metal coated ceramic materials (many such materials having a hardness in a range of from about 5.0 mohs to about 8.5 mohs are well known to those of ordinary skill in the art); and (h) ceramic coated metals (many such materials having a hardness in a range of from about 4.2 mohs to about 8.2 mohs are well known to those of ordinary skill in the art). In addition, it has been discovered that polishing the frets in the manner described above, may further harden a fret comprised of a metal surface due to "work hardening."

Figure 1:
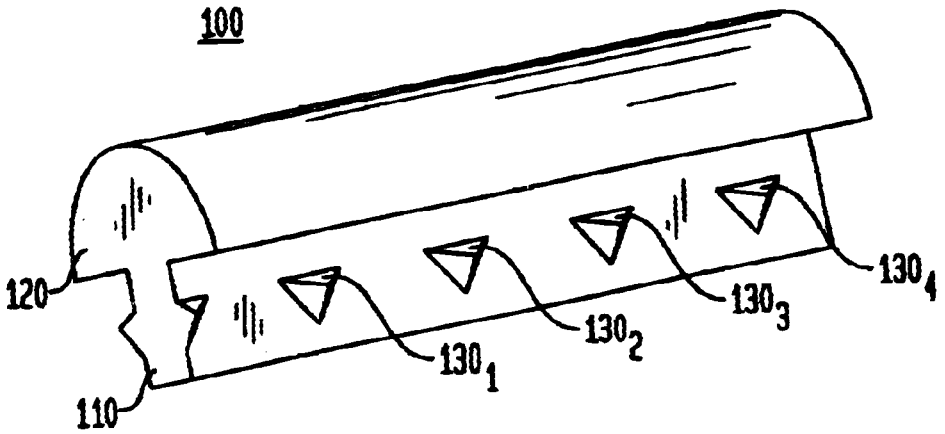
FIG. 1 (PRIOR ART)
FIG. 1 shows a perspective view of a prior art fret.
Figure 3:
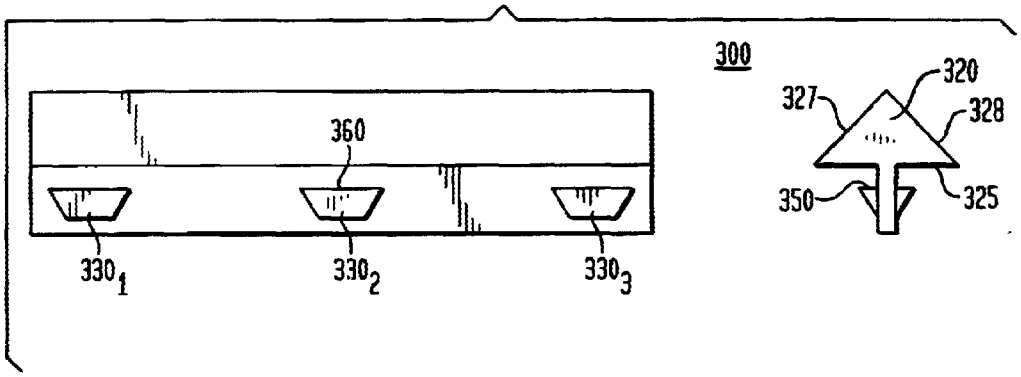
FIGS. 3–5 show side and end views of various embodiments of a fret fabricated in accordance with the present invention.
Figure 4:
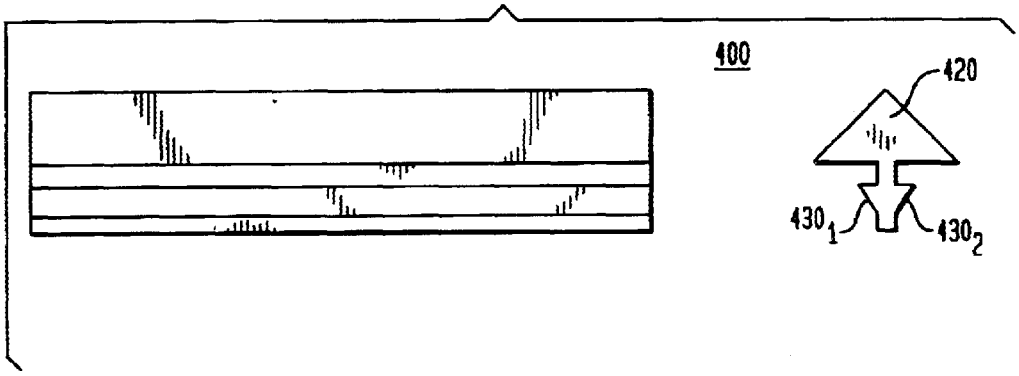
Figure 5:
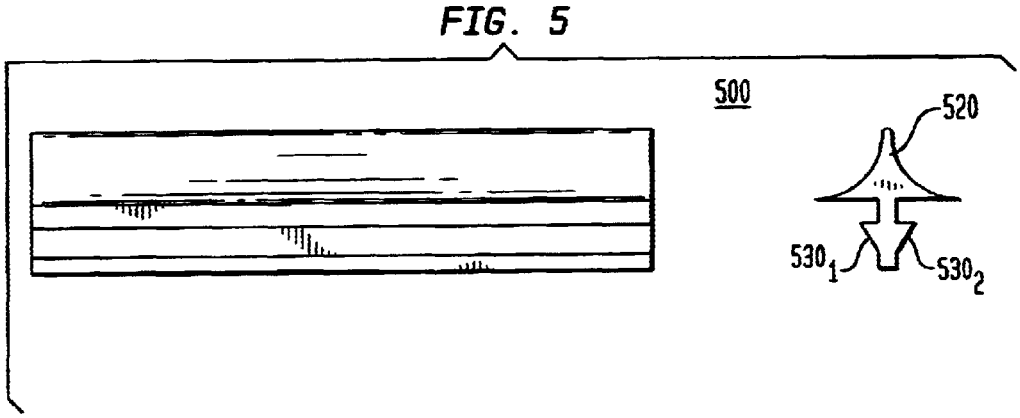

FIGS. 3–5 show side and end views of various embodiments of a fret fabricated in accordance with the present invention. As shown in FIG. 3, studs $\mathbf{330}_1$ to $\mathbf{330}_3$ are in the shape of a wedge. In a side view, a planar, sloping surface of each stud forms a quadrilateral, for example, and without limitation, a trapezoid or a rectangle. By contrast, the shape of prior art studs $\mathbf{130}_1$ to $\mathbf{130}_4$ shown in FIG. 1 are in the shape of a tetrahedron. In accordance with one embodiment of the present invention, the height of the slope of studs $\mathbf{330}_1$ to $\mathbf{330}_3$ (the height being the length of line 350 in FIG. 3) is from about 0.015 inch to about 0.020 inch. By contrast, a corresponding measurement for prior art studs $\mathbf{130}_1$ to $\mathbf{130}_4$ is only about 0.007 inch to about 0.010 inch. In accordance with one embodiment of the present invention, the width of studs $\mathbf{330}_1$ to $\mathbf{330}_3$ (the width being the length of line 360 in FIG. 3) is from about 0.030 inch to about ½ inch long. Lastly, in accordance with one embodiment of the present invention, there could be a spacing of, for example, for about 0.030 inch to about 0.187 inch between studs. It has been discovered that the above-described embodiments seat more reliably in a fingerboard, and hold in the fingerboard much better than prior art frets.

FIGS. 4 and 5 show frets 400 and 500 wherein studs $\mathbf{430}_1$ and $\mathbf{430}_2$ and $\mathbf{530}_1$ and $\mathbf{530}_2$ respectively, extend the entire length of the fret. In such embodiments, the other aspects of the studs (for example, the wedge shape and the height of the wedge) may be the same as was described above for studs $\mathbf{330}_1$ and $\mathbf{330}_3$.

As shown in FIGS. 3 and 4, the sides of caps 320 and 420 have substantially straight edges (the sides of caps 320 and 420, in three dimensions, are substantially planar surfaces). However, the top of cap 420 has a rounding having a small radius (for example, a radius in a range of from about 0.008" to about 0.045"). It should be noted that, in accordance with one embodiment of the present invention, the top of cap 320 may also have a rounding having a small radius.

Lastly, as shown in FIG. 5, the sides of cap 520 form concave lines (the sides of cap 520, in three dimensions, are concave surfaces), and the top of cap 520 has a rounding having a small radius (for example, a radius in a range of from about 0.008"to about 0.045"). Where straight sides are used, the angle between a base of a fret (for example, refer to base 325 of fret 300 shown in FIG. 3) and its sides (for example, refer to sides 327 and 328 of fret 300 shown in FIG. 3) can be from about 25° to 60° for a fret having a base width and height of about ⅛ of an inch. For particularly good results, however, the angle should be approximately 45°.

Although various embodiments that incorporate the teachings of the present invention have been shown and described in detail herein, those skilled in the art can readily devise many other varied embodiments that still incorporate these teachings.

What is claimed is:

1. A fret adapted for insertion into a fingerboard of an instrument, the fret comprising:

a stem adapted to engage the fingerboard when inserted therein, the stem having one or more studs; and a cap having a base joined to one end of the stem;

wherein one or more of the studs comprises a wedge having a sloped side whose area has a quadrilateral shape;

wherein the cap has two sides extending generally toward each other from edges of the base configured so that the sides are substantially straight lines in a cross section of the cap perpendicular to a central axis of the stem; and wherein a top of the cap has a round of small radius.

2. The fret of claim 1 wherein the round has a high polish.

3. The fret of claim 1 wherein a width of the wedge is from about 0.030 inch to about ½ inch.

4. The fret of claim 1 wherein a height of the wedge is from about 0.015 inch to about 0.020 inch.

5. The fret of claim 1 wherein a width of the wedge is the same as the width of the fret.

6. The fret of claim 1 wherein one of the sides makes an angle with respect to the base of about 25° to about 60°.

7. A fret adapted for insertion into a fingerboard of an instrument, the fret comprising:

a stem adapted to engage the fingerboard when inserted therein, the stem having one or more studs; and a cap having a base joined to one end of the stem;

wherein one or more of the studs comprises a wedge having a sloped side whose area has a quadrilateral shape;

wherein the cap has two sides extending generally toward each other from edges of the base configured so that the sides are concave lines in a cross section of the cap perpendicular to a central axis of the stem; and wherein a top of the cap has a round of small radius.

8. The fret of claim 7 wherein the round has a high polish.

9. The fret of claim 7 wherein a width of the wedge is from about 0.030 inch to about ½ inch.

10. The fret of claim 7 wherein a height of the wedge is from about 0.015 inch to about 0.020 inch.

11. The fret of claim 7 wherein a width of the wedge is the same as the width of the fret.

12. A fret adapted for insertion into a fingerboard of an instrument, the fret comprising:

a stem adapted to engage the fingerboard when inserted therein, the stem having one or more studs; and a cap having a base joined to one end of the stem;

wherein one or more of the studs comprises a wedge having a sloped side whose area has a quadrilateral shape;

wherein the fret is comprised of a material having hardness in a range of from about 2.5 mohs to about 8.7 mohs;

wherein the material is one of a stainless steel alloy, a monel alloy, a nickel alloy, a titanium alloy, a molybdenum alloy, a ceramic material, a metal coated ceramic material, and a ceramic coated metal;

wherein the cap has two sides extending generally toward each other from edges of the base configured so that the sides are substantially straight lines in a cross section of the cap perpendicular to a central axis of the stem; and wherein a top of the cap has a round of small radius.

13. The fret of claim 12 wherein the round has a high polish.

14. The fret of claim 12 wherein a width of the wedge is from about 0.030 inch to about ½ inch.

15. The fret of claim 12 wherein a height of the wedge is from about 0.015 inch to about 0.020 inch.

16. The fret of claim 12 wherein a width of the wedge is the same as the width of the fret.

17. The fret of claim 12 wherein one of the sides makes an angle with respect to the base of about 25° to about 60°.

18. A fret adapted for insertion into a fingerboard of an instrument, the fret comprising:

a stern adapted to engage the fingerboard when inserted therein, the stem having one or more studs; and a cap having a base joined to one end of the stem;

wherein one or more of the studs comprises a wedge having a sloped side whose area has a quadrilateral shape;

wherein the fret is comprised of a material having hardness in a range of from about 2.5 mohs to about 8.7 mohs;

wherein the material is one of a stainless steel alloy, a monel alloy, a nickel alloy, a titanium alloy, a molybdenum alloy, a ceramic material, a metal coated ceramic material, and a ceramic coated metal;

wherein the cap has two sides extending generally toward each other from edges of the base configured so that the sides are concave lines in a cross section of the cap perpendicular to a central axis of the stem; and wherein a top of the cap has a round of small radius.

19. The fret of claim 18 wherein the round has a high polish.

20. The fret of claim 18 wherein a width of the wedge is from about 0.030 inch to about ½ inch.

21. The fret of claim 18 wherein a height of the wedge is from about 0.015 inch to about 0.020 inch.

22. The fret of claim 18 wherein a width of the wedge is the same as the width of the fret.

* * * * *